US006679516B2

(12) United States Patent
Andrevon

(10) Patent No.: US 6,679,516 B2
(45) Date of Patent: Jan. 20, 2004

(54) DEVICE FOR RETAINING A BOOT ON A SPORTS APPARATUS

(75) Inventor: Hervé Andrevon, Faverges (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/053,688

(22) Filed: Jan. 24, 2002

(65) Prior Publication Data

US 2002/0101062 A1 Aug. 1, 2002

(30) Foreign Application Priority Data

Jan. 31, 2001 (FR) ..... 01 01536

(51) Int. Cl.[7] ..... A63C 9/00

(52) U.S. Cl. ..... 280/623; 280/809; 280/14.22; 280/634; 36/50.1; 36/50.5

(58) Field of Search ..... 280/11.3, 14.21, 280/14.22, 14.24, 623, 617, 619, 611, 624, 625, 633, 634, 809; 36/117.1, 89, 50.1, 50.5, 58.5

(56) References Cited

U.S. PATENT DOCUMENTS 3,387,305 A * 6/1968 Shafer ..... 2/22
4,476,639 A * 10/1984 Zaccaria ..... 36/114
4,933,630 A * 6/1990 Dupraz ..... 280/607
4,979,760 A * 12/1990 Derrah ..... 280/607
5,045,006 A * 9/1991 Sperzel et al. ..... 441/75
5,056,509 A * 10/1991 Swearington ..... 602/29
5,142,798 A * 9/1992 Kaufman et al. ..... 36/117.4
5,433,636 A * 7/1995 Gillis ..... 441/74
5,647,146 A * 7/1997 Gabrielli et al. ..... 36/54
5,893,785 A * 4/1999 Baldwin, III ..... 441/75
6,076,848 A 6/2000 Rigal et al. ..... 280/634
6,079,128 A * 6/2000 Hoshizaki et al. ..... 36/89
6,094,841 A * 8/2000 Adams ..... 36/99
6,206,403 B1 * 3/2001 Black et al. ..... 280/618
6,237,520 B1 * 5/2001 Sisseren ..... 114/39.19
6,360,454 B1 * 3/2002 Dachgruber et al. ..... 36/54
D455,187 S * 4/2002 Janisch ..... D21/773
6,412,794 B1 * 7/2002 Phillips et al. ..... 280/14.22
2003/0038456 A1 * 2/2003 Carrasca ..... 280/624

FOREIGN PATENT DOCUMENTS

EP 0839557 5/1998
FR 2774302 8/1999

* cited by examiner

*Primary Examiner*—Brian L. Johnson
*Assistant Examiner*—Kelly E Campbell
(74) *Attorney, Agent, or Firm*—Greenblum & Bernstein, P.L.C.

(57) ABSTRACT

A device for retaining a boot on a sports apparatus. The device includes a covering portion, which itself includes a longitudinal reinforcement and a shock-absorbing pad. The hardness of the shock absorbing-pad increases from an inner end toward an outer end of the reinforcement.

18 Claims, 4 Drawing Sheets

DEVICE FOR RETAINING A BOOT ON A SPORTS APPARATUS

CROSS-REFERENCE TO RELATED APPLICATION

This application is based upon French Patent Application No. 01 01536, filed on Jan. 31, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a device for retaining a boot on a sports apparatus, in which the boot is retained by means of at least one strap.

2. Description of Background and Relevant Information

Devices of the aforementioned type are used for snowboarding, snow skiing, waterskiing, snowshoeing, roller skating, and the like.

A strap deuce according to the prior art generally includes at least one strap that extends transversely between an inner fastener and an outer fastener. The strap includes a portion for covering the boot, the covering portion including a longitudinal reinforcement that is substantially inextensible along the length of the strap, and a shock-absorbing pad located beneath the reinforcement The pad includes at least one inner zone and one outer zone, which press down on the boot when the strap is tightened to ensure a uniform distribution of the steering forces, substantially over the length of the reinforcement.

Such a device enables the user to adjust the tightening of the strap. Of course, the stronger the tightening is, the better the boot is held.

It has appeared that for certain styles of operating the apparatus, sometimes it is advantageous to apply a strong tightening force and sometimes advantageous to apply a weal tightening force.

That is the case in snowboarding, for example, where a weak tightening force enables the user to easily bend his or her legs to execute style figures or maneuvers, and where a strong tightening force enables a precise steering of the board.

However, it is not possible to vary the tightening force of the strap while steering. As a result, the user cannot easily execute style figures/maneuvers and steer the board with great precision at the same time. It is necessary to find a compromise.

SUMMARY OF THE INVENTION

An object of the invention in particular is to provide the user with both the possibility to easily execute style figures/maneuvers and the possibility to steer the board with great precision.

To this end, the invention proposes a device for retaining a boot on a sports apparatus, the device including at least one strap provided to retain the boot on the apparatus, the strap extending transversely between an inner fastener and an outer fastener of the device, the strap including a portion for covering the boot, the covering portion including a longitudinal reinforcement that is substantially inextensible along the length of the strap, and a shock-absorbing pad located beneath the reinforcement, the shock-absorbing pad being present in the area of an inner end and of an outer end of the covering portion.

The retaining device according to the invention is characterized in that the hardness of the shock-absorbing pad increases from the inner fastener toward the outer fastener.

The hardness of the shock-absorbing pad on the inner fastener side is low, which provides the boot with a certain slackness inward of the foot, As a result, the user can easily bend the leg laterally inward, i.e., toward the other leg. This facilitates the execution of style figures, i.e. maneuvers.

The hardness of the pad on the outer fastener side is high, which ensures the holding of the boot outward of the foot. As a result, the user can steer the board with great precision.

The change in hardness of the shock-absorbing support or wedge makes it possible to reconcile two modes of operating the apparatus.

BRIEF DESERTION OF D DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

A first embodiment of the invention, to be described below, is shown in FIGS. 1–4.

Figure 1:
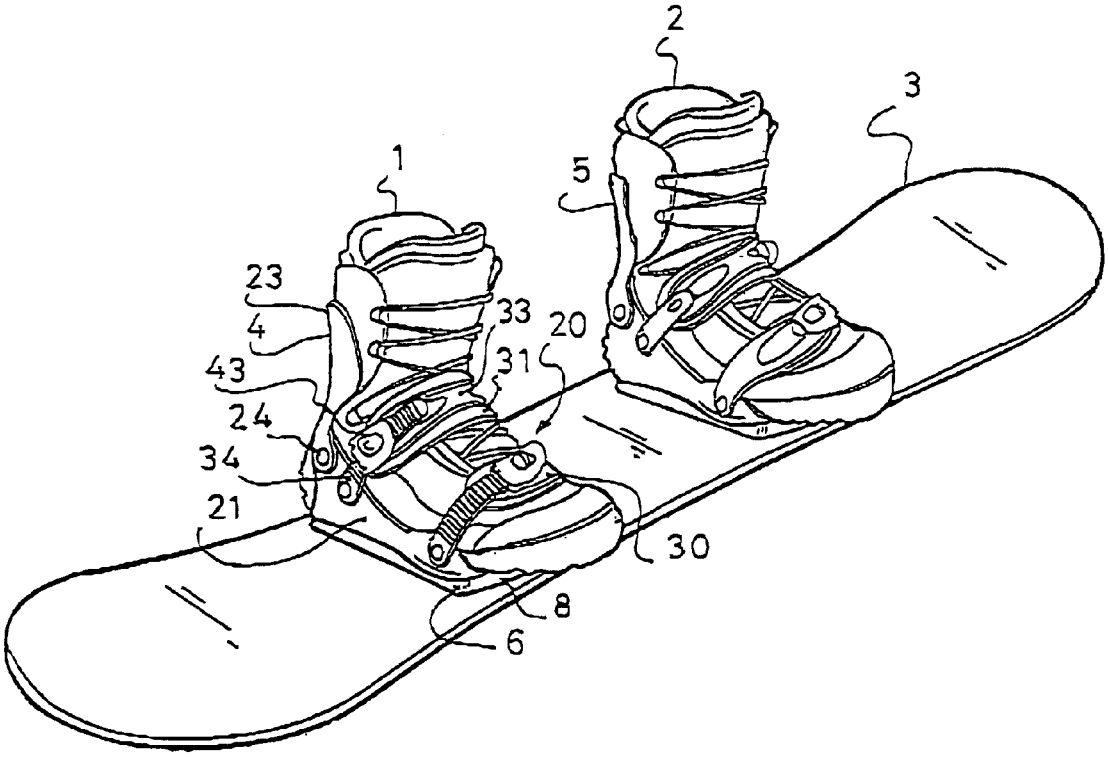
FIG. 1 is a perspective view of a snowboard on which two boots are retained by means of two retaining devices, according to a first embodiment of the invention.

As seen in FIG. 1, two boots 1, 2 are detachably retained on a board 3 by means of two retaining devices 4, 5.

For simplification, only one 4 of the devices is described hereinafter.

Figure 2:
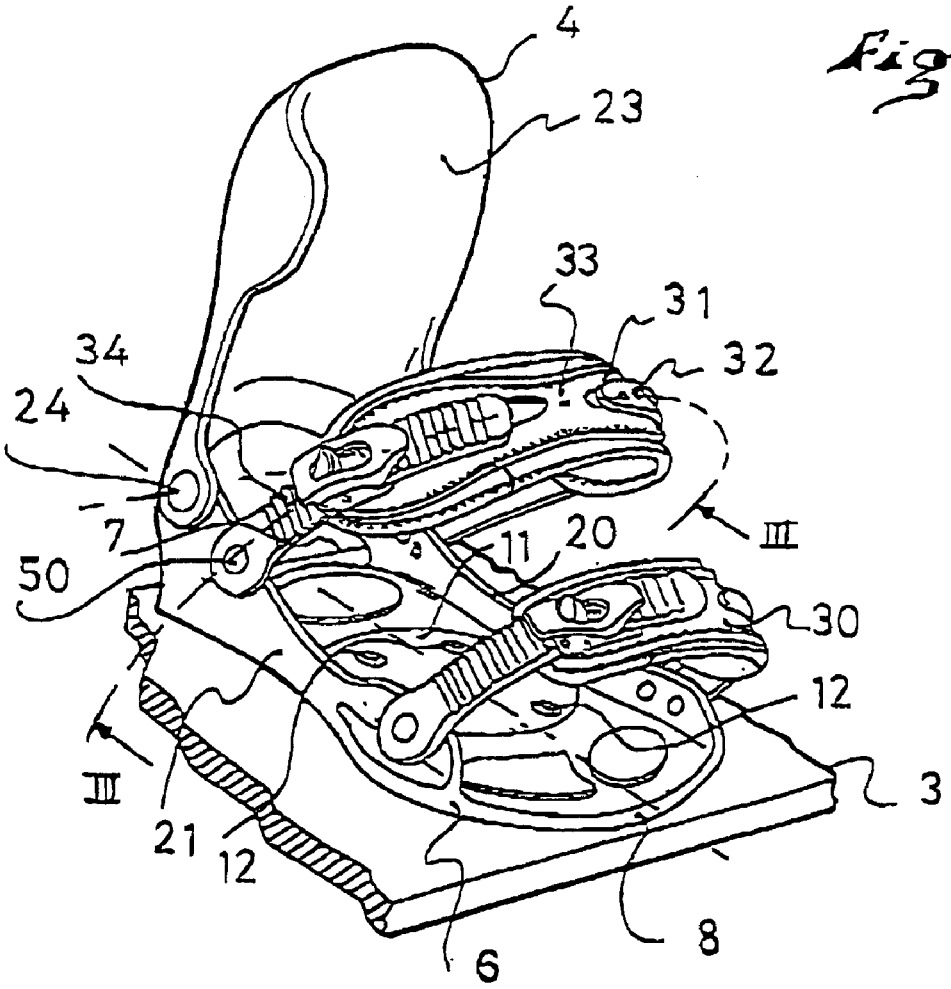
FIG. 2 is a perspective view of a device of FIG. 1.

In a known manner, as seen in FIG. 2, the retaining device 4 includes a base 6 that extends longitudinally between a rear end 7 and a front end 8.

The base 6 has an upper surface 9 provided to face the sole of the boot 1, and a lower surface provided to be above the board 3.

The base 6 is retained on the board 3 by a means shown in the form of a disk 11, itself retained to the board 3 by screws 12.

It is contemplated, however, that other means for retaining the base 6 could be provided.

The base 6 is edged laterally with an inner flange 20 and an outer flange 21. When the boot 1 is in place on the device 4, the inner flange 20 extends along the side of the boot that receives the big toe. Consequently, the outer flange 21 extends along the side of the boot that receives the little toe.

The flanges 20, 21 are connected by an arch in the area of the rear end 7.

Preferably, the base 6, flanges 20, 21, and arch 22 are made as a single piece, i.e., they are unitary, and are made, for example, of a synthetic material. However, the flanges and the arch could be made as pieces that are affixed to the base by any other means, such as glueing, welding, screws, nesting, or the like.

A rear support element 23, sometimes referred to as a high-back, enables the user to take rear supports with the lower leg. The rear support element 23 is affixed to the flanges 20, 21, for example, by means of a journal 24.

Two straps are also provided for detachably retaining the boot 1 on the base 6, between the flanges 20, 21.

A first strap 30 is located toward the front, in the area of the metatarsus when the foot is retained. A second strap 31 is located toward the rear, in the area of the instep when the foot is retained.

It is also contemplated, within the scope of the invention, that a different number of straps could be provided.

For simplification, only one strap is described in detail hereinafter, namely, the instep strap 31.

Figure 3:
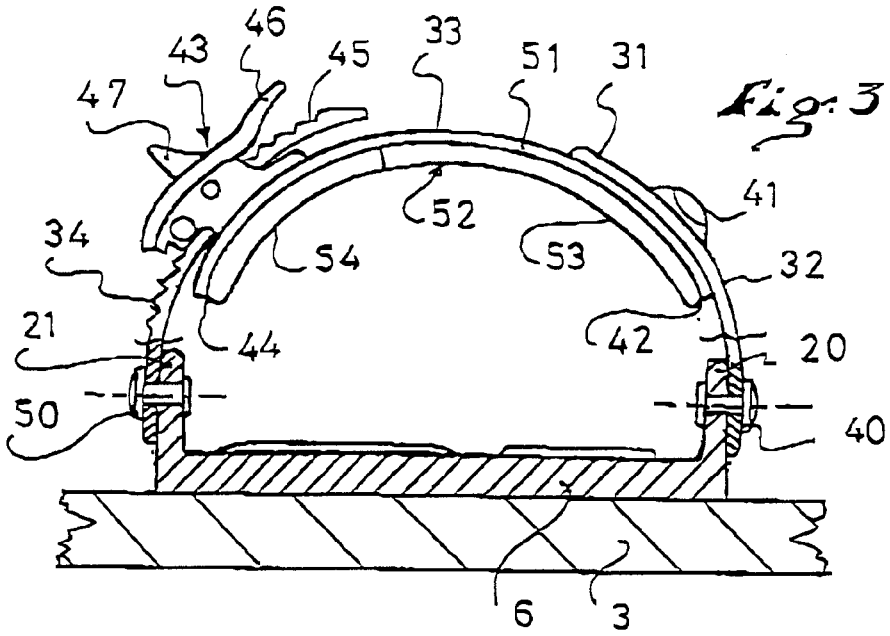
FIG. 3 is a cross-section along the line III—III of FIG. 2.

As seen clearly in FIG. 3, the strap 31 extends transversely from the inner flange 20 to the outer flange 21.

The strap 31 is shown in the form of a succession of tree portions, including an inner portion 32, a covering portion 33, and an outer portion 34.

The inner potion 32 is connected to the inner flange 20 by an inner fastener. The latter is shown in the form of a journal taking the form of a rivet 40, for example.

The inner portion 32 is adjustably superimposed on the covering portion 33, for example by means of a screw 41. Thus, the user can cause an inner end 42 of the covering portion 33 to be proximate the inner flange 20. The positional adjustment of the covering portion 33 in relation to the inner portion 32 is rarely modified. It is provided to take the boot space requirement into account.

A means is provided to detachably connect the covering portion 33 to the outer portion 34. This means includes, for example, a ratchet tightening mechanism 43 fixed to the covering portion 33, at the level of an outer end 44 of the latter. The structure which connects the covering 33 and outer 34 portions also includes a series of teeth 45 configured on the outer portion 34.

By actuating a lever 46 of the mechanism 43, it is possible to tighten the strap 31 by bringing the outer end 44 closer to the outer flange 21. By actuating a button 47 of the mechanism 43, it is possible to loosen the strap 31, or even to open it. In this latter case, the covering portion 33 and the outer portion 34 are separated.

It is contemplated, within the scope of the invention, that other means could be provided for connecting the covering 33 and outer 34 portions.

The outer portion 34 is connected to the outer flange 21 by an outer fastener. The latter is shown in the form of a journal taking the form of a rivet 50, for example.

The two journals occur substantially along a transverse axis of the device, which enables the strap 31 to uniformly cover the boot.

It is contemplated, within the scope of the invention, that the journals could take other forms, such as screws, pins, or the like.

Similarly, the fastenings of the strap 31 to the flanges 20, 21 could be carried out by other means, such as a winding around a keeper, or the like.

The strap 31 is substantially inextensible lengthwise, i.e., from one flange 20, 21 to the other The materials of which it is made are selected to this end. In particular, the inner 32 and outer 34 portions are preferably made in the form of a band made of a synthetic material, such as polyamide or reinforced or non-reinforced polyurethane. The coveting portion 33 includes a reinforcement 51 that is both relatively flexible in bending and substantially inextensible longitudinally.

A shock-absorbing layer or pad 52, located beneath the reinforcement 51, can be provided for taking support on the boot.

It is to be understood that the pad 52 is a continuous or discontinuous band, whose thickness can be constant or variable. However, in all cases, the pad 52 is present in the area of the inner end 42 and in the area of the outer end 44 of the covering portion 33.

In FIG. 3, the shock-absorbing pad 52 is shown in the form of a band having a constant thickness It extends from the inner end 42 to the outer end 44 of the covering portion 33.

According to the invention, the hardness of the shock-absorbing pad 52 increases from the inner fastener toward the outer fastener.

The increase in hardness is obtained preferably by juxtaposing two portions, an inner portion 53 and an outer portion 54. The hardness of the outer portion 54 is greater than that of the inner portion 53.

The difference in hardness results from the differences in the mechanical properties of the materials, such as density, modulus of elasticity, or the like, or yet from their chemical composition.

Preferably, the inner 53 and outer 54 portions are made of synthetic materials, such as rubber, silicone, polyurethane, or the like.

For example, the inner portion 53 can be made of polyurethane foam, and the outer portion with solid rubber.

The relative flexibility of the inner portion 53 provides the boot with a certain slackness inward of the foot. This enables the user to bend the leg inward to execute certain maneuvers, such as style figures. The relative rigidity of the outer portion 54 ensures the holding of the boot outward of the foot. Tis enables a direct transmission of the steeling forces. The board can be steered more precisely.

A greater number of portions could be provided to constitute the shock-absorbing pad 52, according to the invention. The hardnesses of each portion would be selected to ensure a progressive increase in hardness from the inner end 42 toward the outer end 44 of the covering portion 33.

In all cases, the constituent portions of the pad 52 are affixed to the reinforcement 51 by any means, such as an adhesive, a weld, stitching, or the like.

Other layers could be added to the covering portion 33.

For example, a covering layer can be provided beneath the pad 52 to protect the latter The covering layer is preferably made of fabric in order not to disturb the behavior of the wedge or pad.

Figure 4:
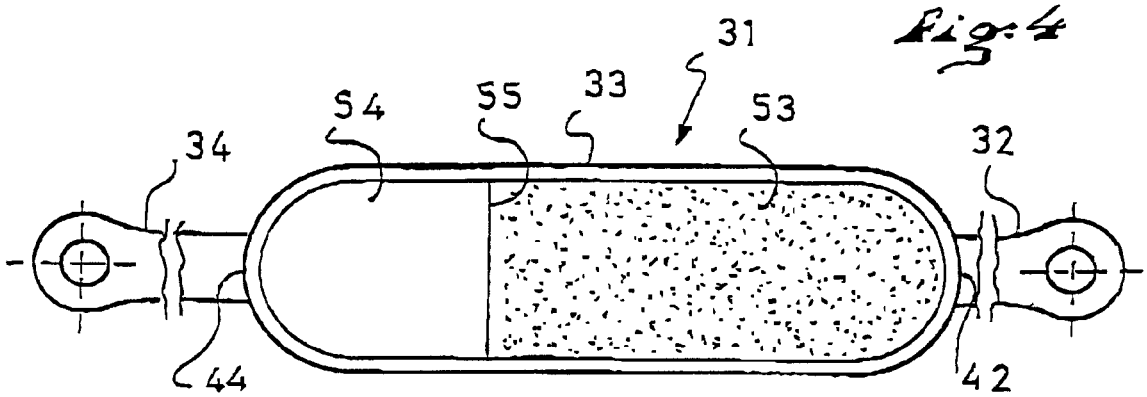
FIG. 4 is a bottom view of a strap of the device of FIG. 2.

As seen in FIG. 4, the separating limit 55 between the inner 53 and outer 54 portions is shown in the form of a straight line oriented transversely in relation to the strap 31. This limit 55 could have other forms, or it could be inclined.

Furthermore, the limit 55 is preferably off-centered toward the outer end 44, with respect to the middle of the ends 42, 44. This provides the inner portion 53 with a larger surface than that of the outer portion 54. Thus, the covering portion 33 is more rigid outward of the device.

The other embodiments of the invention are briefly presented hereinafter, Given that they have numerous points in common with the first example, only the differences are shown.

Figure 5:
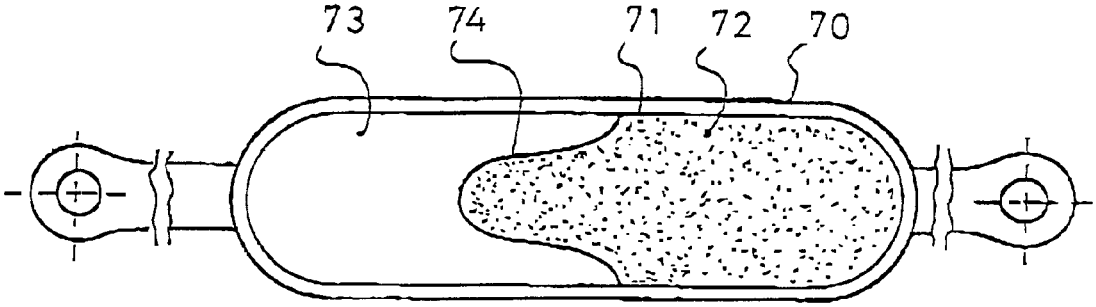
FIG. 5 is a view similar to FIG. 4, according to a second embodiment of the invention.

For the second example, as seen in FIG. 5, a covering portion 70 receives a pad 71 that includes a flexible inner portion 72 and a harder outer portion 73. The limit 74 separating the portions 72, 73 is incurved, the portions nesting into one another longitudinally. It is thus possible to vary the stiffness of the pad 71, and therefore of the covering portion 70, in a more progressive manner.

Figure 6:
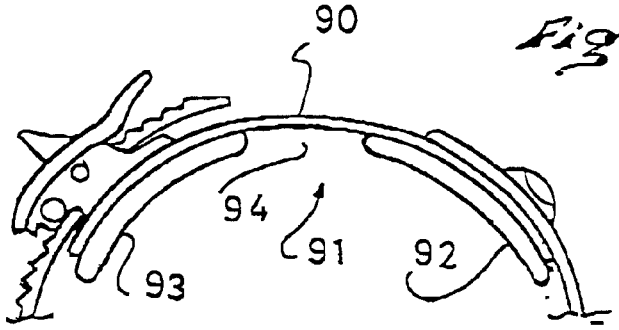
FIG. 6 a view Similar to FIG, 3, according to a third embodiment of the invention.

For the third example, as seen in FIG. 6, a covering portion 90 receives a pad 91 formed by two separate portions, a flexible inner portion 92 and a harder outer portion 93. The free zone 94 formed between the portions of the pad 91 makes it possible to locally reduce the pressure exerted by the foot through the boot, for example in the area of the tendon of the big toe.

In all cases, the invention is embodied from materials and according to implementation techniques known to a person having ordinary skill in the arts The invention is not limited to the particular examples disclosed hereinabove, and includes all of the technical equivalents that fall within e scope of the claims that follow.

In particular, each strap of a device can be structured as the strap described.

Each strap could include a different number of portions, for example two portions, an inner portion and a covering portion which is attached directly to the flanges.

Furthermore, the base and the flanges are not necessary; the fasteners of the straps can be obtained directly on the apparatus.

Moreover, although the examples described relate to the field of snowboarding, the invention is applicable to other technical fields, including snow skis, water skis, snowshoes, roller skates, and the like.

What is claimed is:

1. A device for retaining a boot on a sports apparatus, said device comprising:

at least one strap to retain the boot on the apparatus, the strap extending transversely between an inner fastener and an outer fastener, the strap including a portion for covering the boot, the covering portion including a longitudinal reinforcement, said longitudinal reinforcement being substantially inextensible along a length of the strap, and a shock-absorbing pad located beneath the reinforcement, said shock-absorbing pad being positioned in an area of an inner end and of an outer end of the covering portion, said shock-absorbing pad progressively increases in hardness from the inner end toward the outer end.

2. A retaining device according to claim 1, wherein the shock-absorbing pad includes two portions, said two portions comprising a relatively flexible inner portion and a relatively hard outer portion.

3. A retaining device according to claim 2, wherein the two inner and outer portions are juxtaposed.

4. A retaining device according to claim 1, wherein a supplemental layer is added to the covering portion.

5. A retaining device according to claim 4, wherein the supplemental layer is made of fabric and arranged beneath the pad.

6. A retaining device according to claim 1, wherein the strap includes three portions, said three portions including an inner portion, said covering portion, and an outer portion.

7. A retaining device according to claim 6, wherein the inner fastener is obtained by a journal of the inner portion on an inner flange, wherein the outer fastener is obtained by a journal of the outer portion on an outer flange, and wherein the flanges transversely extend along a base of the device.

8. A device for retaining a boot on a sports apparatus, said device comprising:

at least one strap to retain the boot on the apparatus, the strap extending transversely between an inner fastener and an outer fastener;

said strap at least comprising a portion for covering the boot, said covering portion of said strap comprising:

a longitudinal reinforcement, said longitudinal reinforcement being substantially inextensible along a length of said strap;

a shock-absorbing pad located beneath said reinforcement, said shock-absorbing pad comprising an inner end portion and an outer end portion, said shock-absorbing pad progressively increase in hardness from the inner end portion of said shock-absorbing pad toward the outer end portion.

9. A retaining device according to claim 8, wherein said inner end portion and said outer end portion are in abutment.

10. A retaining device according to claim 9, wherein said inner end portion and said outer end portion are spaced apart by means of a free zone.

11. A retaining device according to claim 8, wherein said shock-absorbing pad has a constant thickness.

12. A retaining device according to claim 8, wherein said longitudinal reinforcement has an inner end and an outer end, wherein said shock-absorbing pad has an inner end and an outer end, wherein said inner end of said shock-absorbing pad extends at least to said inner end of said longitudinal reinforcement and wherein said outer end of said shock-absorbing pad extends at least to said outer end of said longitudinal reinforcement.

13. A retaining device according to claim 8, wherein said shock-absorbing pad further comprises an inner end, an outer end, and a middle between said inner and outer ends, said inner end of said shock-absorbing pad being no harder than said middle of said shock-absorbing pad and said middle of said shock-absorbing pad being no harder than said outer end of said shock-absorbing pad.

14. A device for retaining a boot on a sports apparatus, said device comprising:

a base for supporting the boot;

an inner flange extending upwardly along an inner side of said base adapted to be positioned nearest a side of the boot housing the big toe of the wearer of the boot;

an outer flange extending upwardly along an outer side of said base adapted to be positioned nearest a side of the boot housing the little toe of the wearer of the boot;

at least one strap extending from said inner flange to said outer flange, said strap comprising:

a covering portion adapted to extend over the boot, said covering portion extending between an inner end and an outer end, said inner end of said covering portion being closer to said inner flange and said outer end of said covering portion being closer to said outer flange;

an inner portion connected to said inner flange and connected to said covering portion;

an outer portion connected to said outer flange and connected to said covering portion;

said covering portion further comprising:

a reinforcement extending along said covering portion, said reinforcement being substantially inextensible along a length of said strap;

a shock-absorbing layer positioned beneath said reinforcement, said shock-absorbing layer extending between an inner end and an outer end, said inner end of said shock-absorbing layer being closer to said inner flange and said outer end of said shock-absorbing layer being closer to said outer flange;

in an area of said outer end of said shock-absorbing layer said shock-absorbing layer being harder than in an area of said inner end of said shock-absorbing layer.

15. A retaining device according to claim 14, wherein between said area of said outer end of said shock-absorbing layer and said area of said inner end of said shock-absorbing layer is a free zone, said shock-absorbing layer being discontinued in said free zone, thereby defining an inner portion of said shock-absorbing layer and an outer portion of said shock-absorbing layer, said inner and outer portions of said shock-absorbing layers being spaced-apart by means of said free zone.

16. A retaining device according to claim 14, further comprising an adjustable tightening mechanism connecting said outer portion of said strap to said covering portion of said strap.

17. A device for retaining a boot on a sports apparatus, said device comprising:

a base for supporting the boot;

an inner flange extending upwardly along an inner side of said base adapted to be positioned nearest a side of the boot housing the big toe of the wearer of the boot;

an outer flange extending upwardly along an outer side of said base adapted to be positioned nearest a side of the boot housing the little toe of the wearer of the boot;

at least one strap extending from said inner flange to said outer flange, said strap comprising:

a covering portion adapted to extend over the boot, said covering portion extending between an inner end and an outer end, said inner end of said covering portion being closer to said inner flange and said outer end of said covering portion being closer to said outer flange;

an inner portion connected to said inner flange and connected to said covering portion;

an outer portion connected to said outer flange and connected to said covering portion;

said covering portion further comprising:

a reinforcement extending along said covering portion, said reinforcement being substantially inextensible along a length of said strap;

a shock-absorbing layer positioned beneath said reinforcement, said shock-absorbing layer extending between an inner end and an outer end, said inner end of said shock-absorbing layer being closer to said inner flange and said outer end of said shock-absorbing layer being closer to said outer flange;

said shock-absorbing layer progressively increasing in hardness from an area of said inner end of said shock-absorbing layer to an area of said outer end of said shock-absorbing layer.

18. A retaining device according to claim 17, further comprising an adjustable tightening mechanism connecting said outer portion of said strap to said covering portion of said strap.

* * * * *